US009580939B2

(12) United States Patent
Fujiwara et al.

(10) Patent No.: US 9,580,939 B2
(45) Date of Patent: Feb. 28, 2017

(54) VEHICLE DOOR LATCH RELEASE DEVICE

(71) Applicant: KABUSHIKI KAISHA HONDA LOCK, Miyazaki-shi, Miyazaki (JP)

(72) Inventors: Hiroto Fujiwara, Miyazaki (JP); HIroyuki Kouzuma, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 159 days.

(21) Appl. No.: 14/376,469

(22) PCT Filed: Jan. 9, 2013

(86) PCT No.: PCT/JP2013/050220
§ 371 (c)(1),
(2) Date: Aug. 4, 2014

(87) PCT Pub. No.: WO2013/118526
PCT Pub. Date: Aug. 15, 2013

(65) Prior Publication Data

US 2015/0001861 A1 Jan. 1, 2015

(30) Foreign Application Priority Data

Feb. 9, 2012 (JP) ..... 2012-026213

(51) Int. Cl.
*E05B 3/00* (2006.01)
*E05B 81/00* (2014.01)
(Continued)

(52) U.S. Cl.
CPC ..... *E05B 81/00* (2013.01); *E05B 81/90* (2013.01); *E05B 85/12* (2013.01);
(Continued)

(58) Field of Classification Search
CPC ..... E05B 81/00; E05B 81/76; E05B 81/90; E05B 53/003; E05B 53/005;
(Continued)

(56) References Cited

U.S. PATENT DOCUMENTS 5,642,636 A * 7/1997 Mitsui ..... E05B 17/0062 292/201
6,048,002 A * 4/2000 Ohta ..... E05B 81/20 292/201
(Continued)

FOREIGN PATENT DOCUMENTS

CN 1410643 A 4/2003
CN 1993530 A 7/2007
(Continued)

OTHER PUBLICATIONS

Official Communication dated Sep. 30, 2015 issued over the corresponding CN Patent Application 201380008728.2.
(Continued)

*Primary Examiner* — Alyson M Merlino
(74) *Attorney, Agent, or Firm* — Carrier Blackman & Associates, P.C.; Joseph P. Carrier; Anne G. Sabourin

(57) ABSTRACT

A vehicle door latch release device is provided in which a latch device enabling latch release in response to operation of an electric actuator and mechanical input of a latch release operating force is provided on a door, and input of a mechanical latch release operating force into the latch device is enabled in an emergency in which latch release by the electric actuator is disabled, wherein a human power acting on the emergency operating member, which can be operated by a vehicle user, can be transmitted as a mechanical latch release operating force to the latch device via operating force transmission means, and restriction/permission switching means can switch between an operation restricted state in which operation of the emergency oper-
(Continued)

ating member is restricted and an operation permitted state in which operation of the emergency operating member is enabled in response to a predetermined operation by a vehicle user.

3 Claims, 6 Drawing Sheets

(51) Int. Cl.
*E05B 81/90* (2014.01)
*E05B 85/12* (2014.01)
*E05B 63/00* (2006.01)
*E05B 79/20* (2014.01)

(52) U.S. Cl.
CPC ..... *E05B 63/0065* (2013.01); *E05B 79/20* (2013.01); *Y10T 292/57* (2015.04)

(58) Field of Classification Search
CPC ..... E05B 63/0065; E05B 77/22; E05B 79/20; E05B 79/22; E05B 85/12
USPC ..... 292/336.3, 201, 216, DIG. 23, DIG. 65
See application file for complete search history.

(56) References Cited

U.S. PATENT DOCUMENTS 7,866,714 B2 * 1/2011 Monig ..... E05B 81/76 292/336.3
8,528,949 B2 9/2013 Katsumata et al.
2002/0063432 A1 * 5/2002 Choi ..... E05B 83/16 292/336.3
2003/0047951 A1 * 3/2003 Belchine, III ..... E05B 1/0038 292/336.3
2003/0227177 A1 * 12/2003 Matsuda ..... E05B 81/06 292/216
2005/0077734 A1 * 4/2005 Lim ..... E05B 83/26 292/216
2008/0073918 A1 * 3/2008 Arabia ..... E05B 81/20 292/201
2009/0212577 A1 8/2009 Fukunaga et al.
2009/0236863 A1 * 9/2009 Akizuki ..... E05B 81/14 292/201
2011/0112689 A1 5/2011 Riegelman et al.
2012/0139269 A1 * 6/2012 Kouzuma ..... E05B 81/14 292/195

FOREIGN PATENT DOCUMENTS

EP 1 666 685 B1 8/2008
JP S64-18268 U 1/1989
JP H06-35091 Y2 9/1994
JP 2006-151315 A 6/2006
JP 2011-094436 A 5/2011

OTHER PUBLICATIONS

Supplementary European Search Report dated Feb. 3, 2016 corresponding to European Patent Application No. EP 13 74 7048.

* cited by examiner

VEHICLE DOOR LATCH RELEASE DEVICE

TECHNICAL FIELD

The present invention relates to a vehicle door latch release device that includes an operating member for latch release that is operated by a vehicle user in order to release a latched state of a door, an electric actuator that is operated in response to the operating member for latch release being operated, and a latch device that is provided on the door so as to enable latch release in response to operation of the electric actuator and mechanical input of a latch release operating force, input of a mechanical latch release operating force into the latch device being enabled in an emergency in which latch release by the electric actuator is disabled.

BACKGROUND ART

An arrangement in which a push button provided on a grip part of a door so as to face the vehicle compartment side is pushed by a small stroke portion when the situation is normal to thus operate an electric actuator, thereby releasing a latched state of a latch device, and in an emergency when electrical latch release of the latch device becomes impossible due to a flat battery, etc., the push button is pushed in by a larger stroke than normal to thus input a mechanical latch release operating force into the latch device is already known from Patent Document 1.

RELATED ART DOCUMENTS

Patent Document

Patent Document 1: Japanese Utility Model Publication No. 6-35091

SUMMARY OF THE INVENTION

Problems to be Solved by the Invention

In the arrangement disclosed in Patent Document 1 above, both at a time of normal operation and at a time of emergency operation the common push button is pushed in; since no means is provided for restricting the operation of deep pushing of the push button at a time of normal operation, there is a possibility that an emergency operation will mistakenly be carried out at a time of normal operation, and there is a possibility that an erroneous operation will occur.

The present invention has been accomplished in light of such circumstances, and it is an object thereof to provide a vehicle door latch release device that can prevent an emergency operation from being mistakenly carried out when it is unnecessary to input a mechanical latch release operating force into a latch device.

Means for Solving the Problems

In order to attain the above object, according to a first aspect of the present invention, there is provided a vehicle door latch release device comprising an operating member for latch release that is operated by a vehicle user in order to release a latched state of a door, an electric actuator that is operated in response to the operating member for latch release being operated, and a latch device that is provided on the door so as to enable latch release in response to operation of the electric actuator and mechanical input of a latch release operating force, input of a mechanical latch release operating force into the latch device being enabled in an emergency in which latch release by the electric actuator is disabled, characterized in that the vehicle door latch release device comprises an emergency operating member that can be operated by a vehicle user, operating force transmission means that transmits a human power acting on the emergency operating member to the latch device as a mechanical latch release operating force, and restriction/permission switching means that switches between an operation restricted state in which operation of the emergency operating member is restricted and an operation permitted state in which operation of the emergency operating member is enabled in response to a predetermined operation by a vehicle user.

Further, according to a second aspect of the present invention, in addition to the first aspect, the operating member for latch release and the restriction/permission switching means are operatively linked so that the restriction/permission switching means is switched from the operation restricted state to the operation permitted state in response to operation of the operating member for latch release by a vehicle user in a mode different from operation of the operating member for latch release in order to operate the electric actuator.

An electric motor for latch release 14 of an embodiment corresponds to the electric actuator of the present invention, a push button 35 of the embodiment corresponds to the operating member for latch release of the present invention, and a front side door D of the embodiment corresponds to the door the present invention.

Effects of the Invention

In accordance with the first aspect of the present invention, the emergency operating member for inputting a mechanical latch release operating force into the latch device via the operating force transmission means becomes operable in response to the restriction/permission switching means attaining the operation permitted state in response to a predetermined operation by a vehicle user; since it is necessary for the vehicle user to carry out the predetermined operation in order to operate the emergency operating member, it is possible to avoid the emergency operating member from being operated unnecessarily.

Furthermore, in accordance with the second aspect of the present invention, since the restriction/permission switching means is switched from the operation restricted state to the operation permitted state in response to the operating member for latch release being operated by a vehicle user in a mode different from operation of the operating member for latch release in order to operate the electric actuator, it is possible to minimize the number of operating members for the vehicle user to be aware of, and it is possible to easily carry out an operation of inputting a mechanical latch release operating force to the latch device even in an emergency.

EXPLANATION OF REFERENCE NUMERALS AND SYMBOLS

Figure 1:
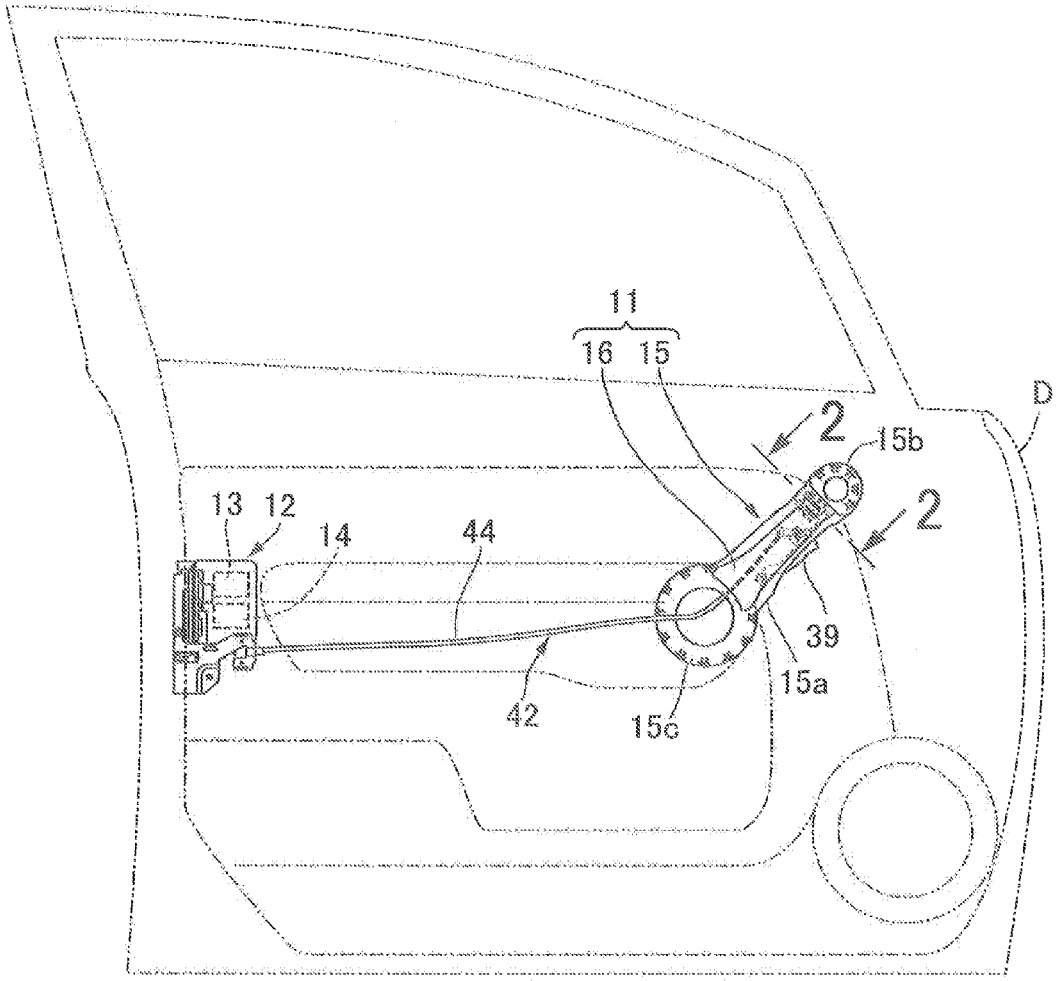
FIG. 1 is a side view of a first embodiment showing positions where a handle and a latch device are disposed on a front side door when viewed through the front side door. (first embodiment)

12 Latch device
14 Electric motor for latch release, which is an electric actuator
35 Push button, which is an operating member for latch release
39 Emergency operating member
42 Operating force transmission means
48A, 48B Restriction/permission switching means
D Front side door, which is a door

MODES FOR CARRYING OUT THE INVENTION

Modes for carrying out the present invention are explained below by reference to the attached drawings.

FIRST EMBODIMENT

A first embodiment of the present invention is explained by reference to FIG. 1 to FIG. 5. First, in FIG. 1, a door of a passenger vehicle, for example, a front side door D, has mounted thereon a handle 11 for a vehicle user to carry out an open/close operation of the front side door D on the vehicle compartment side and has disposed thereon a latch device 12 that enables switching between a latched state in which a closed state of the front side door D is maintained by engaging with the vehicle body side and an unlatched state in which the front side door D can be opened. This latch device 12 includes a reversible electric motor for an lock/unlock switch 13 that exhibits power for switching between an unlocked state in which latch release of the front side door D is enabled and a locked state in which latch release of the front side door D is disabled, and an electric motor for latch release 14, which is an electric actuator that exhibits power for releasing the latched state in the unlocked state. The latch device 12 can carry out latch release in response to a mechanical input of a latch release operating force either in the locked state or the unlocked state.

Figure 2:
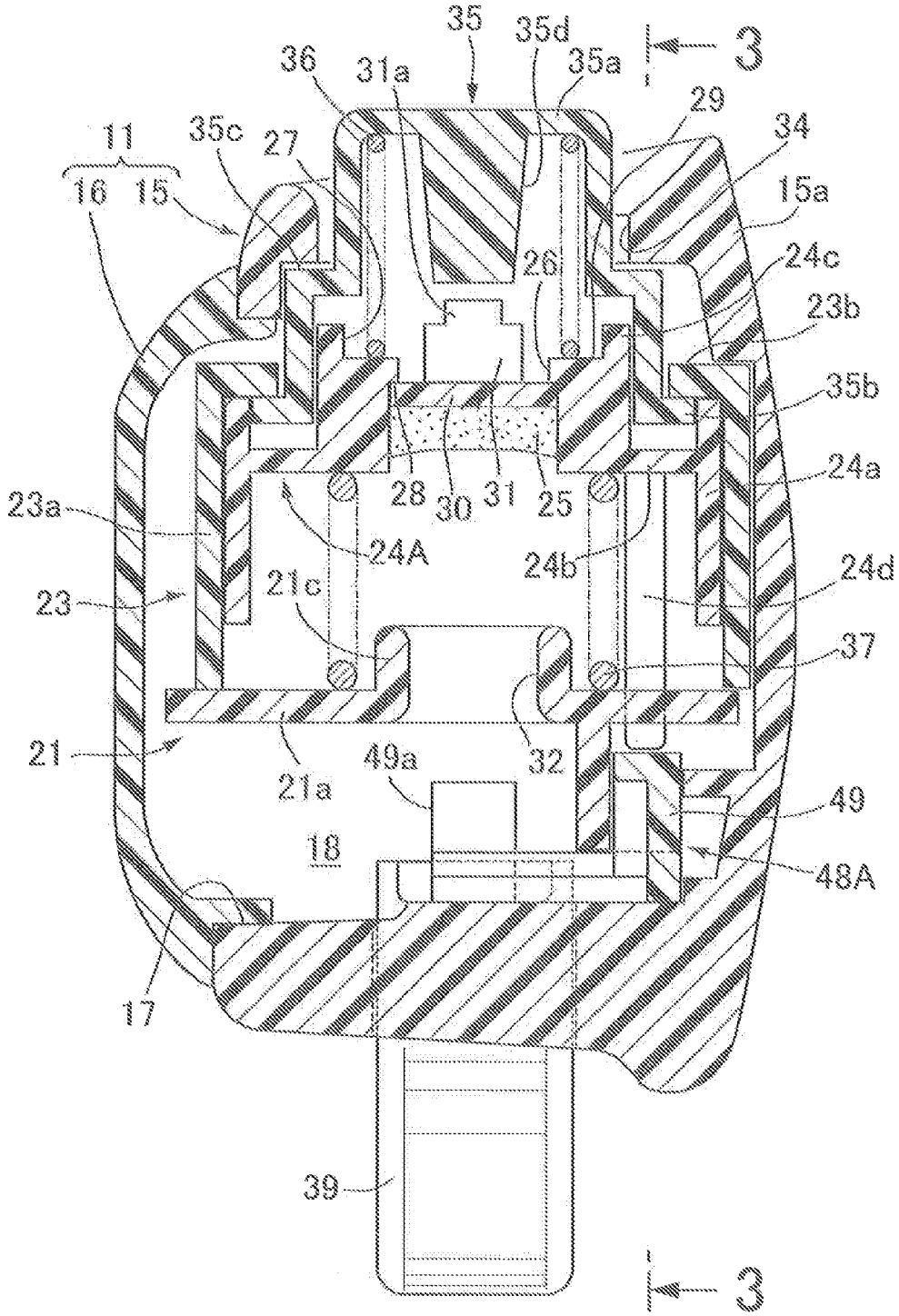
FIG. 2 is an enlarged sectional view along line 2-2 in FIG. 1. (first embodiment)
Figure 3:
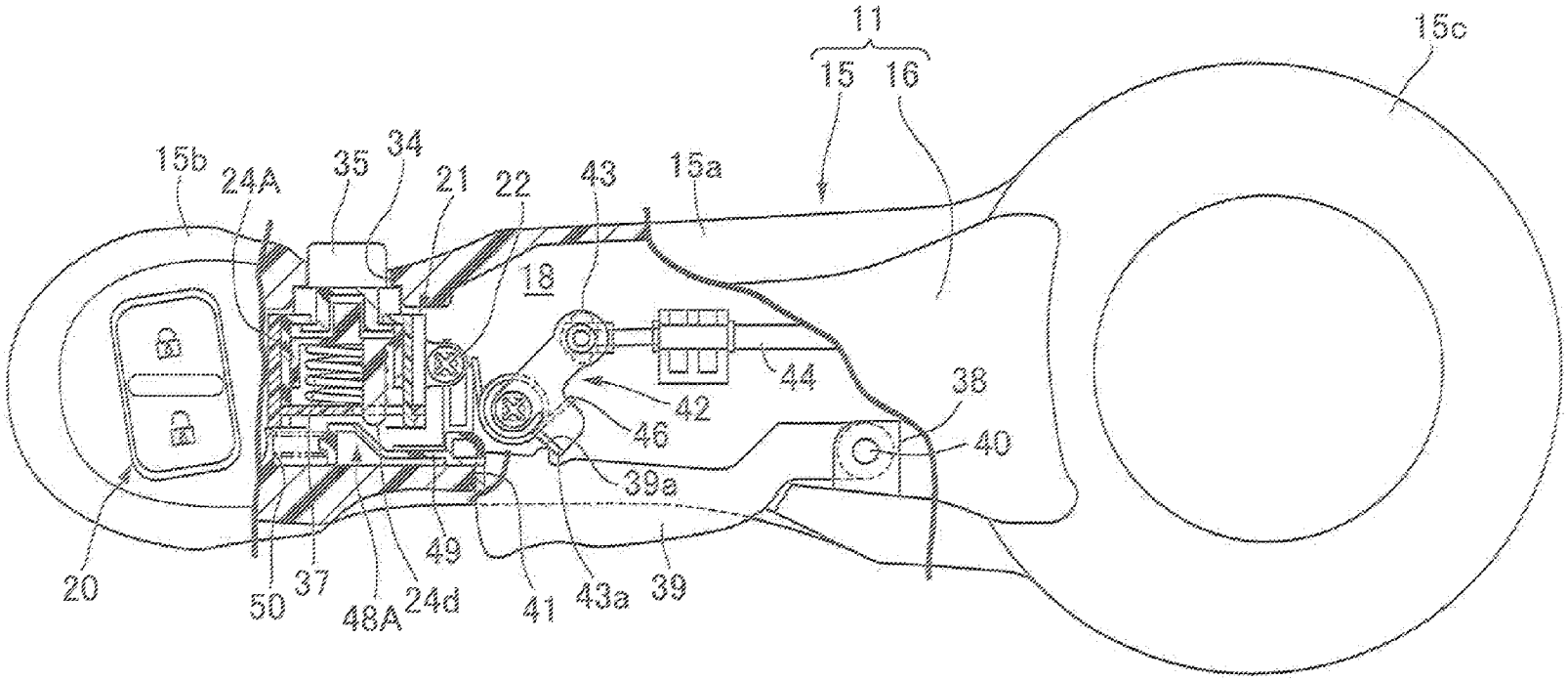
FIG. 3 is a sectional view along line 3-3 in FIG. 2. (first embodiment)

Referring in addition to FIG. 2 and FIG. 3, the handle 11 is formed from a handle main body 15 and a lid member 16 mounted on the handle main body 15 so as to close an opening 17 that is provided in the handle main body 15 and that opens on an inner face side of the front side door, so as to form a hollow part 18 in the interior.

The handle main body 15 is formed from a grip portion 15*a* extending lengthwise in the fore-and-aft direction of the vehicle, a circular front support portion 15*b* provided so as to be connected to the front end of the grip portion 15*a*, and a rear support portion 15*c* formed into a circular shape that is larger than the front support portion 15*b* and provided so as to be connected to the rear end of the grip portion 15*a*. The front support portion 15*b* and the rear support portion 15*c* of the handle main body 15, which is inclined upwardly toward the front, are fixed to the inner face side of the front side door D.

Disposed on a face, opposing the interior of the vehicle compartment, of the front support portion 15*b* of the handle main body 15 as clearly shown in FIG. 3 is a switch for lock/unlock switching 20, which operates the electric motor for lock/unlock switching 13 of the latch device 12 by switching between forward and reverse directions of rotation.

Figure 4:
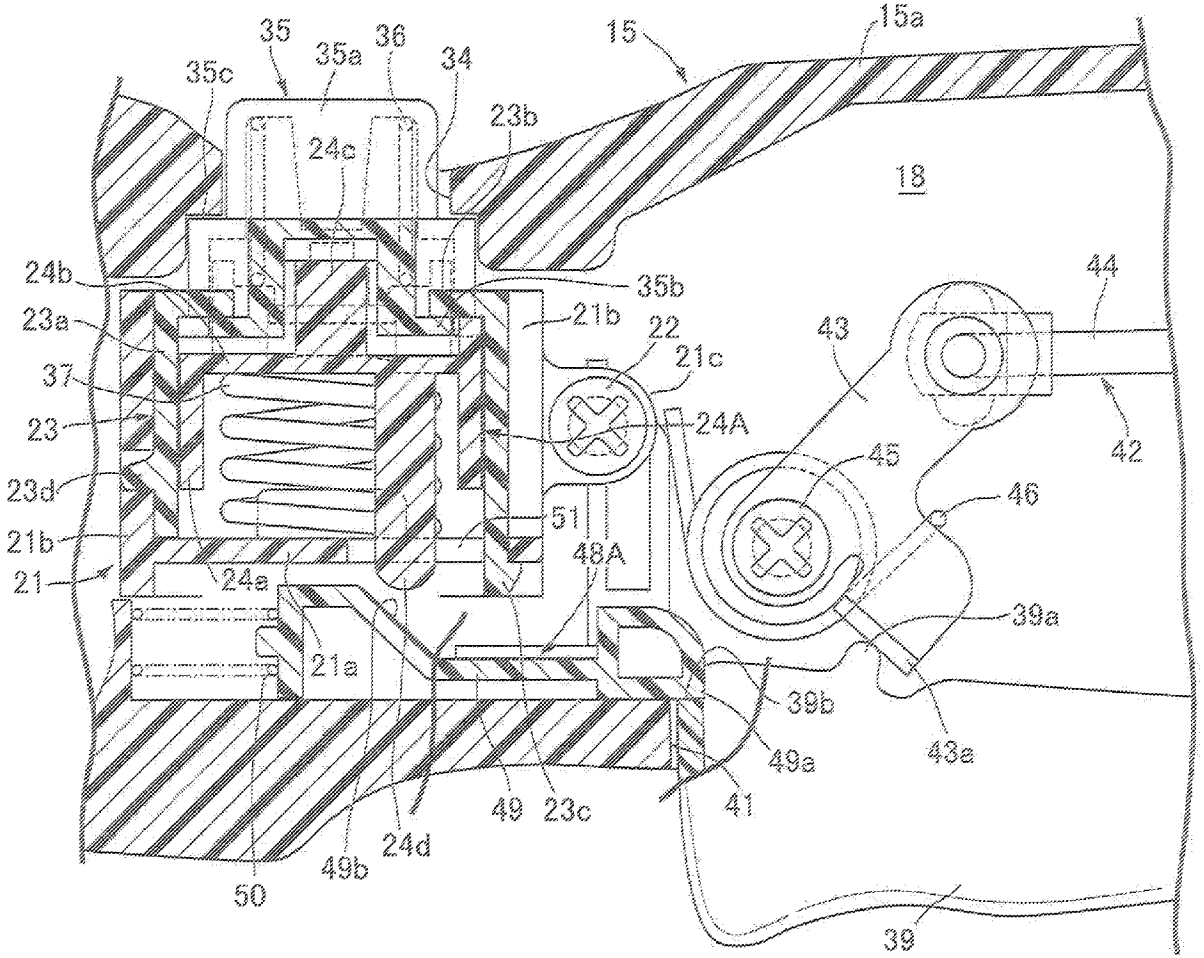
FIG. 4 is an enlarged view of an essential part of FIG. 3. (first embodiment)

Referring in addition to FIG. 4, disposed within the hollow part 18 in a front part of the grip portion 15*a* in the proximity of the front support portion 15*b* is a bracket 21 having a flat disk-shaped support plate portion 21*a* and support leg portions 21*b* that are connectedly provided integrally with a plurality of locations spaced in the peripheral direction on the outer periphery of the support plate portion 21*a* and that extend in the vertical direction. A mounting arm portion 21*c* integrally provided with one of the support leg portions 21*b* and protruding sideways is secured to the handle main body 15 by means of a screw member 22. That is, the bracket 21 is fixed to the handle main body 15 and disposed within the hollow part 18.

Fixed to the bracket 21 is a switch case 23. This switch case 23 integrally has a first cylindrical portion 23*a* that is inserted into the plurality of support leg portions 21*b* of the bracket 21 and has a lower end part abutting against the support plate portion 21*a* of the bracket 21 from above, and a first inward collar portion 23*b* that protrudes radially inwardly from the upper end of the first cylindrical portion 23*a*.

Projectingly provided integrally with a plurality of locations in the peripheral direction of the lower end of the first cylindrical portion 23*a* is an engagement claw portion 23*c* that is inserted through a through hole 51 provided in the support plate portion 21*a* and resiliently engages with the support plate portion 21*a* from below, and projectingly provided integrally with an outer face of a plurality of locations in the peripheral direction of the first cylindrical portion 23*a* is an engagement projecting portion 23*d* that resiliently engages with a support leg portion 21*b* selected from the plurality of support leg portions 21*b* of the bracket 21. By resiliently engaging the engagement claw portion 23*c* and the engagement projecting portion 23*d* with the support plate portion 21*a* and the support leg portion 21*b* of the bracket 21 the switch case 23 is fixed to the bracket 21.

A switch holder 24A is floatingly supported in the switch case 23, this switch holder 24A integrally having a second cylindrical portion 24*a* slidably fitted into the first cylindrical portion 23*a* of the switch case 23, a second inward collar portion 24*b* protruding radially inwardly from an inner face of an intermediate part of the second cylindrical portion 24*a*, and a third cylindrical portion 24*c* extending upwardly from the inner periphery of the second inward collar portion 24*b*.

Referring to FIG. 2, provided within the third cylindrical portion 24*c* in sequence from a lower part are a board mounting hole 25 with a rectangular cross section having one end opening downwardly, a small diameter hole 26 with a circular cross section formed so as to be smaller than the board mounting hole 25 and having one end connected to the other end of the board mounting hole 25, and a large diameter hole 27 with a circular cross section formed so as to be larger than the board mounting hole 25, having one end coaxially connected to the other end of the small diameter hole 26, and having its other end opening upwardly. Formed between said other end of the board mounting hole 25 and said one end of the small diameter hole 26 is a downwardly facing annular first step part 28, and between said other end of the small diameter hole 26 and said one end of the large diameter hole 27 is an upwardly facing annular second step part 29.

Inserted into the board mounting hole 25 is a rectangular board 30 having an edge on the outer periphery abutting against the first step part 28, and fixed onto the board 30 is a tact switch 31 that has a to-be-pressed portion 31*a* in the center of an end part on the side opposite to the board 30 and changes switching mode in response to application of a pressing force to the to-be-pressed portion 31*a*. Furthermore, a cylindrical projecting portion 21*c* forming an outlet hole 32 is provided integrally with a central part of the support plate portion 21*a* of the bracket 21 so as to protrude upwardly, and a wire (not illustrated) extending from the board 30 is guided outside the switch case 23 via the outlet hole 32.

A circular button insertion hole 34 is provided in a front upper face of the grip portion 15*a* of the handle 11 so as to correspond to the switch case 23 and the switch holder 24A, and a push button 35 is disposed in the button insertion hole 34, the push button 35 being an operating member for latch release.

The push button 35 integrally has a button main portion 35*a* formed into a stepped bottomed cylindrical shape having an upper end closed and having a third step portion 35*c* on the outer periphery of an intermediate part, a collar portion 35*b* protruding radially outwardly from the lower end of the button main portion 35*a*, and a rod-shaped pressing portion 35*d* extending downwardly from an inner face of a central part at the blocked end of the button main portion 35*a*.

A lower part of the button main portion 35*a* is inserted into an upper part of the switch case 23 so that the collar portion 35*b* opposes from below the first inward collar portion 23*b* at the upper end of the switch case 23, and an upper part of the button main portion 35*a* is inserted into the button insertion hole 34 so that the third step portion 35*c* opposes from below the peripheral edge at the inner end of the button insertion hole 34, the pressing portion 35*d* opposing the to-be-pressed portion 31*a* of the tact switch 31 from above.

Furthermore, a first return spring 36, which is a coil spring, is provided in a compressed state between the second step part 29 of the switch holder 24A and the blocked part at the upper end of the push button 35, and in a natural state in which no external force is applied, the end of upward movement of the push button 35 urged upward by the first return spring 36 is restricted by the collar portion 35*b* of the push button 35 abutting against the first inward collar portion 23*b* at the upper end of the switch case 23 from below, in this process the blocked part at the upper end of the push button 35 being positioned so as to project upwardly slightly from a front part of the grip portion 15*a* of the handle 11.

When the push button 35 is pushed in against the spring force of the first return spring 36 the pressing portion 35*d* pushes the to-be-pressed portion 31*a* of the tact switch 31 from above to thus change the switching mode of the tact switch 31, and due to the collar portion 35*b* of the push button 35 abutting against the second inward collar portion 24*b* of the switch holder 24A, change in the relative position in the vertical direction between the push button 35 and the switch holder 24A is restricted. In response to a change in the switching mode of the tact switch 31, the electric motor for latch release 14 of the latch device 12 operates so as to exhibit power for releasing the latched state.

Furthermore, a second return spring 37, which is a coil spring, is provided in a compressed state between the second inward collar portion 24*b* of the switch holder 24A and the support plate portion 21*a* of the bracket 21, and the spring force of the second return spring 37 is set so as to be larger than the spring force of the first return spring 36. Therefore, in a state in which the push button 35 has been pushed in against the spring force of the first return spring 36 and change in the relative position in the vertical direction between the push button 35 and the switch holder 24A is restricted, when the push button 35 is pushed in against the spring force of the second return spring 37 with a larger force the push button 35 and the switch holder 24A move downwardly within the switch case 23.

A supporting projection part 38 is projectingly provided on a lower part of the grip portion 15*a* of the handle main body 15 of the handle 11 as shown in FIG. 3, and a rear end part of an emergency operating member 39, which is formed lengthwise along the longitudinal direction of the grip portion 15*a*, is pivotably supported on the supporting projection part 38 via a support shaft 40.

Furthermore, a through hole 41, which is long in the fore-and-aft direction, is provided in the lower part of the grip portion 15*a*, a front part of the emergency operating member 39 projecting from the through hole 41 below the grip portion 15*a*; a vehicle user holding the grip portion 15*a* can pivotingly operate the emergency operating member 39 in the vertical direction, and the pivoting position of the emergency operating member 39 in a non-operated state is restricted by a lower part of an intermediate section of the emergency operating member 39 abutting against a rear end part of the through hole 41.

A human force inputted by a vehicle user into the emergency operating member 39 is transmitted as a mechanical latch release operating force to the latch device 12 via operating force transmission means 42, the operating force transmission means 42 including a lever 43 housed within the hollow part 18 above the front part of the emergency operating member 39, and wire 44 having one end part linked to the lever 43 and the other end part linked to the latch device 12.

The lever 43 is pivotably supported by a screw member 45 screwed into the grip portion 15*a* while having an axis parallel to the support shaft 40 axially supporting the emergency operating member 39, and said one end part of the wire 44 is linked to the lever 43 at a position offset from the axis of the screw member 45.

Furthermore, a pressure-receiving portion 43*a* is provided integrally with the lever 43 at a position offset from the axis of the screw member 45, and a pressing projecting portion 39*a* is projectingly provided on the front part of the emergency operating member 39, the pressing projecting portion 39*a* abutting against the pressure-receiving portion 43*a* from below. When the emergency operating member 39 pivotingly operates upwardly, a pressing force is transmitted from the pressing projecting portion 39*a* to the pressure-receiving portion 43*a*, the lever 43 pivots in a counterclockwise direction in FIG. 4, in response thereto the wire 44 is pulled, and a latch release operating force is mechanically inputted into the latch device 12.

Moreover, a third return spring 46, which is a torsion spring, is provided between the grip portion 15*a* of the handle main body 15 and the lever 43, the lever 43 being urged by means of the spring force of the third return spring 46 to the side where it pivots in the clockwise direction in FIG. 4.

Operation of the emergency operating member 39 is restricted by restriction/permission switching means 48A in a normal state, this restriction/permission switching means 48A being capable of switching between an operation restricted state in which operation of the emergency operating member 39 is restricted and an operation permitted state in which operation of the emergency operating member 39 is enabled in response to a predetermined operation by a vehicle user.

The restriction/permission switching means 48A includes a slide member 49 supported in a lower part within the grip portion 15*a* of the handle main body 15 so that it can slide in the fore-and-aft direction and disposed in front of the emergency operating member 39, a spring 50 provided between the grip portion 15*a* and the slide member 49 so as to exhibit a spring force urging the slide member 49 toward the emergency operating member 39, and a pressing rod portion 24*d* extending downwardly from the second inward collar portion 24*b* of the switch holder 24A and opposing an intermediate section of the slide member 49 from above.

A latching face 39*b* is formed on an upper part at the front end of the emergency operating member 39, and an engagement portion 49*a* is provided on an end part, on the emergency operating member 39 side, of the slide member 49, the engagement portion 49*a* engaging with the latching face 39*b* from above. In a normal state in which the vehicle user has not carried out the predetermined operation, the engagement portion 49*a* of the slide member 49, which has been urged by the spring 50 and moved toward the emergency operating member 39, is engaged with the latching face 39*b* of the emergency operating member 39 from above, the restriction/permission switching means 48A is in an operation restricted state, and in this state operation of the emergency operating member 39 is restricted.

A pressure-receiving face 49*b* is formed on an upper face of an intermediate section of the slide member 49, the pressure-receiving face 49*b* being inclined so as to be positioned upward in going away from the emergency operating member 39. The pressing rod portion 24*d* provided integrally with the switch holder 24A extends through a through hole 51 provided in the support plate portion 21*a* of the bracket 21, and opposes the pressure-receiving face 49*b* from above on the side away from the emergency restricting member 39 in the operation restricted state, in which the engagement portion 49*a* of the slide member 49 is engaged with the latching face 39*b* of the emergency operating member 39 from above to thus restrict operation of the emergency operating member 39.

Figure 5:
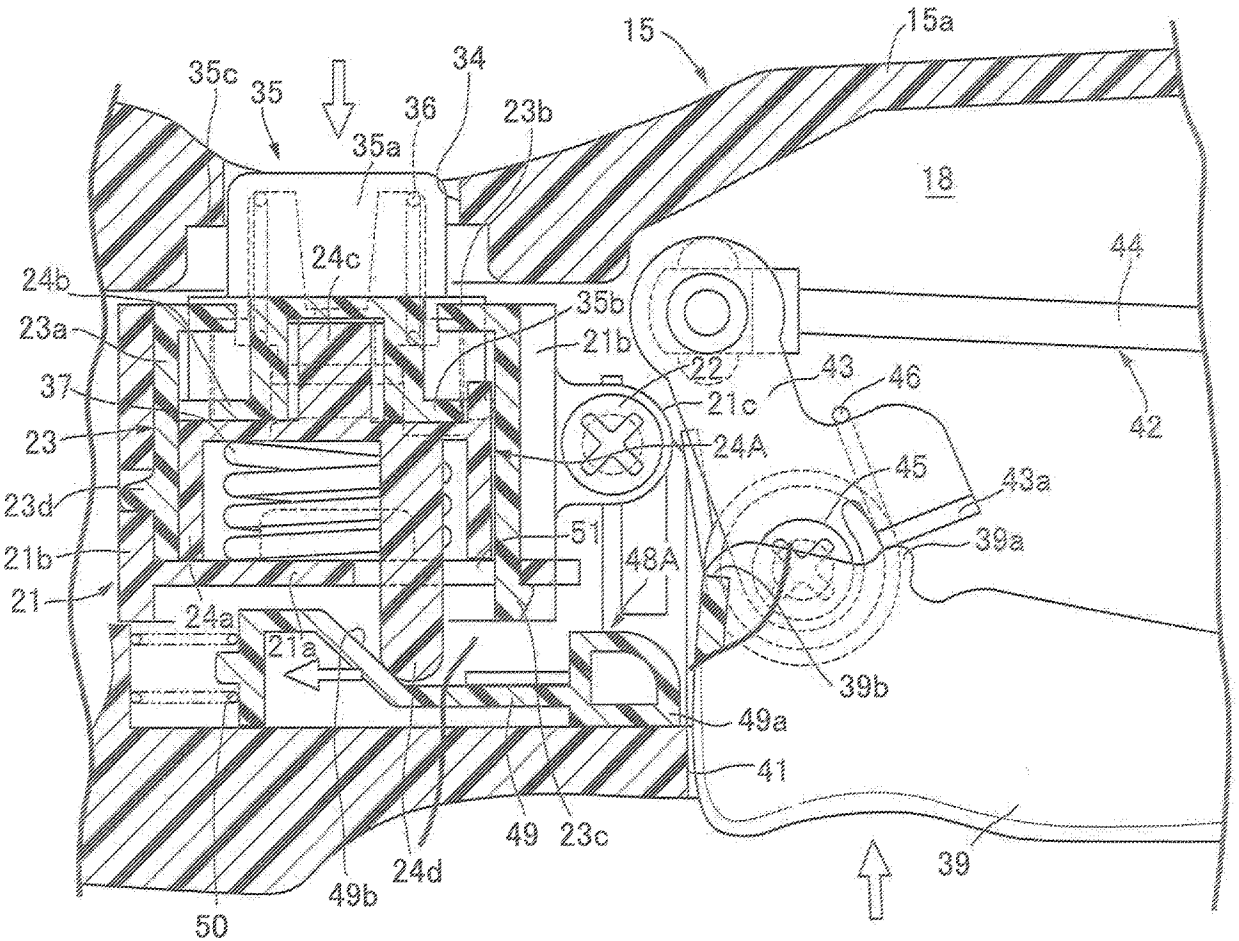
FIG. 5 is a sectional view, corresponding to FIG. 4, in a state in which an emergency operating member is operated. (first embodiment)

In this first embodiment, the predetermined operation by the vehicle user in order to switch the restriction/permission switching means 48A from the operation restricted state, in which operation of the emergency operating member 39 is restricted, to the operation permitted state, in which operation of the emergency operating member 39 is enabled, is an operation of pushing in the push button 35 with a larger force against the spring force of the second return spring 37 after pushing in the push button 35 against the spring force of the first return spring 36, and as shown in FIG. 5, due to the push button 35 and the switch holder 24A moving downwardly within the switch case 23, the pressing rod portion 24*d* pushes the pressure-receiving face 49*b* of the slide member 49 from above, and the slide member 49 thereby slides to the side away from the emergency operating member 39 while compressing the spring 50. As a result, engagement of the latching face 39*b* of the emergency operating member 39 with the engagement portion 49*a* of the slide member 49 is released, the restriction/permission switching means 48A attains the operation permitted state, and pivoting operation of the emergency operating member 39 is enabled. That is, the push button 35 and the restriction/permission switching means 48A are operatively linked so as to switch from the operation restricted state to the operation permitted state.

The operation of this first embodiment is now explained. The emergency operating member 39, which can be operated by a vehicle user, is pivotably supported on the grip portion 15*a* of the handle main body 15 of the handle 11, and a human force due to the emergency operating member 39 being operated by the vehicle user is transmitted as a mechanical latch release operating force to the latch device 12 via the operating force transmission means 42. Since the restriction/permission switching means 48A switches between the operation restricted state, in which operation of the emergency operating member 39 is restricted, and the operation permitted state, in which operation of the emergency operating member 39 is enabled in response to the predetermined operation by the vehicle user, it is necessary for the vehicle user to carry out the predetermined operation in order to operate the emergency operating member 39, and it is possible to avoid the emergency operating member 39 from being operated unnecessarily.

Furthermore, since the push button 35 and the restriction/permission switching means 48A are operatively linked so that the restriction/permission switching means 48A is switched from the operation restricted state to the operation permitted state in response to operation in a different mode from that for operation of the push button 35 for operating the electric motor for latch release 14, in this first embodiment operation of the push button 35 with a larger operating stroke than the operating stroke of the push button 35 for operating the electric motor for latch release 14, it is possible to minimize the number of operating members for a vehicle user to be aware of, and it is possible even in an emergency to easily carry out an operation for inputting a mechanical latch release operating force to the latch device 12.

SECOND EMBODIMENT

Figure 6:
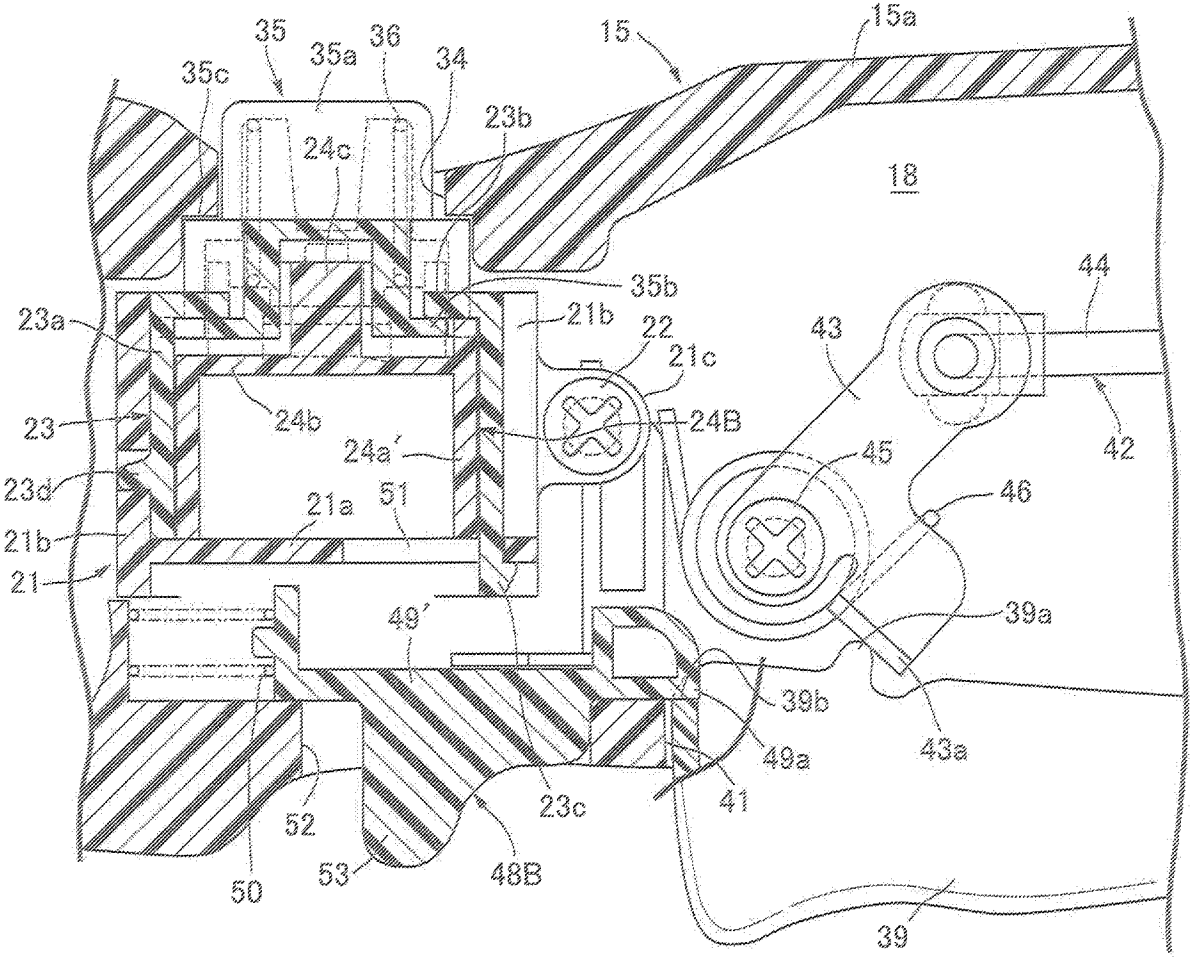
FIG. 6 is a sectional view, corresponding to FIG. 4, of a second embodiment. (second embodiment)

A second embodiment of the present invention is explained by reference to FIG. 6. Parts corresponding to those of the first embodiment are only denoted and illustrated by the same reference numerals and symbols, and a detailed explanation thereof is omitted.

A switch holder 24B supported on a switch case 23 integrally has a second cylindrical portion 24*a*' fitted within a first cylindrical portion 23*a* of the switch case 23, a second inward collar portion 24*b* protruding radially inwardly from an inner face of an intermediate section of the second cylindrical portion 24*a*', and a third cylindrical portion 24*c* extending upwardly from the inner periphery of the second inward collar portion 24*b*, the lower end of the second cylindrical portion 24*a*' abutting against a support plate portion 21*a* of a bracket 21, and the upper end of the second cylindrical portion 24*a*' abutting against a first inward collar portion 23*b* of the switch case 23. That is, the switch holder 24B is housed and fixed within the switch case 23.

Restriction/permission switching means 48B switches between an operation restricted state in which operation of an emergency operating member 39 is restricted and an operation permitted state in which operation of the emergency operating member 39 is enabled in response to a predetermined operation by a vehicle user, this restriction/permission switching means 48B including a slide member 49' supported in a lower part within a grip portion 15*a* of a handle main body 15 so that it can slide in the fore-and-aft direction and disposed in front of the emergency operating member 39, and a spring 50 provided between the grip portion 15*a* and the slide member 49' so as to exhibit a spring force urging the slide member 49' toward the emergency operating member 39.

A latching face 39*b* is formed on an upper part at the front end of the emergency operating member 39, and an engagement portion 49*a* is provided in an end part, on the emergency operating member 39 side, of the slide member 49', the engagement portion 49*a* engaging with the latching face 39*b* of the emergency operating member 39 from above.

Furthermore, an operating part 53 is provided integrally with a lower part of the slide member 49', the operating part 53 protruding downwardly from an elongated hole 52 provided in a lower part of the grip portion 15*a* of the handle main body 15 and extending lengthwise in the fore-and-aft direction, operating this operating part 53 enabling a state in which the engagement portion 49*a* is engaged with the latching face 39*b* of the emergency operating member 39 from above to be released.

That is, a predetermined operation by a vehicle user in order to switch the restriction/permission switching means 48B from the operation restricted state, in which operation of the emergency operating member 39 is restricted, to the operation permitted state, in which operation of the emergency operating member 39 is enabled, is in this second embodiment an operation of sliding the slide member 49' to the side away from the emergency operating member 39 by means of the operating part 53.

In accordance with the second embodiment also, it is possible to avoid the emergency operating member 39 from being operated unnecessarily.

Embodiments of the present invention are explained above, but the present invention is not limited to the embodiments and may be modified in a variety of ways as long as the modifications do not depart from the spirit and scope thereof.

For example, in the embodiments above, the electric motor for latch release 14 is included within the latch device 12, but it may be mounted on a door so as to be disposed outside the latch device 12.

The invention claimed is:

1. A vehicle door latch release device comprising:

an operating member for latch release that is operated by a vehicle user in order to release a latched state of a door, an electric actuator that is operated in response to the operating member for latch release being operated, a latch device that is provided on the door so as to enable its release in response to operation of the electric actuator and mechanical input of a latch release operating force, the mechanical input of the latch release operating force into the latch device being enabled in an emergency in which the release of the latch device by the electric actuator is disabled, an emergency operating member that can be operated by a vehicle user, operating force transmission means that transmits a manual actuation of the emergency operating member to the latch device as the mechanical input of the latch release operating force, and restriction/permission switching means that switches between an operation restricted state in which operation of the emergency operating member is restricted and an operation permitted state in which operation of the emergency operating member is enabled in response to a predetermined operation by a vehicle user, wherein the operating member for latch release and the emergency operating member are formed as separate members from each other and are configured to be arranged together with the restriction/permission switching means in a handle that is used by a vehicle user in an operation to open and close the door.

2. The vehicle door latch release device according to claim 1, wherein the operating member for latch release and the restriction/permission switching means are operatively linked so that the restriction/permission switching means is switched from the operation restricted state to the operation permitted state in response to the predetermined operation of the operating member for latch release by a vehicle user in a mode different from operation of the operating member for latch release in order to operate the electric actuator.

3. The vehicle door latch release device according to claim 1, wherein the operation of the emergency operating member includes a pivoting motion caused by a manual actuation of the emergency operating member, by a direct manual contact with the handle by a user.

* * * * *